United States Patent [19]

Scheufeld et al.

[11] 4,405,094

[45] Sep. 20, 1983

[54] THREAD BRAKE

[75] Inventors: Heinz Scheufeld, Korschenbroich; Ulrich Lossa, Krefeld, both of Fed. Rep. of Germany

[73] Assignee: Palitex Project-Company GmbH, Krefeld, Fed. Rep. of Germany

[21] Appl. No.: 250,318

[22] Filed: Apr. 2, 1981

[30] Foreign Application Priority Data

Apr. 19, 1980 [DE] Fed. Rep. of Germany ..... 3015182
Nov. 5, 1980 [DE] Fed. Rep. of Germany ... 8029436[U]

[51] Int. Cl.[3] ..... B65H 59/22
[52] U.S. Cl. ..... 242/149; 57/279
[58] Field of Search ..... 242/149, 147 R, 150 R, 242/151, 152, 152.1, 153, 154; 57/279

[56] References Cited

U.S. PATENT DOCUMENTS

| | | | |
|---|---|---|---|
| 1,826,354 | 10/1931 | Lenk | 242/149 |
| 3,309,858 | 3/1967 | Franzen | 242/151 X |
| 3,352,510 | 11/1967 | Franzen | 242/149 |
| 3,490,221 | 1/1970 | Heimes et al. | 242/149 X |
| 3,783,597 | 1/1974 | Grieve et al. | 242/149 X |
| 4,030,683 | 6/1977 | Eckholt | 242/149 |
| 4,186,898 | 2/1980 | Wilson et al. | 242/152.1 |
| 4,199,929 | 4/1980 | Vessella | 57/279 |
| 4,281,508 | 8/1981 | Frentzel-Beyme | 242/149 X |
| 4,287,712 | 9/1981 | Franzen | 57/279 |
| 4,297,834 | 11/1981 | Franzen | 242/149 X |

FOREIGN PATENT DOCUMENTS

| | | |
|---|---|---|
| 190036 | 12/1922 | United Kingdom . |
| 288442 | 4/1928 | United Kingdom . |

*Primary Examiner*—Stanley N. Gilreath

[57] ABSTRACT

In a thread brake having two coaxial braking surface rings 2, 3 arranged in spaced relationship to one another and a capsule-shaped braking cartridge 7 whose hemispherical ends bear against the braking surface rings, to make it easier to thread a thread through the brake and the two braking surface rings are each provided with an axial threading slot 2', 3' so that a thread which is inserted sideways into the threading slots in the two braking surface rings can be automatically introduced between the braking surfaces in a simple and reliable manner by tightening or tensioning the thread.

5 Claims, 2 Drawing Figures

THREAD BRAKE

BACKGROUND OF THE PRESENT INVENTION

The invention relates to a thread brake generally of the kind having two co-axial braking surface rings arranged in spaced relationship to one another, and a capsule shaped braking cartridge whose rounded (hemispherical) ends bear against the braking surface rings.

Thread brakes of this general kind are disclosed in Germah Patent Specification No. 15 10 807 for example.

For a thread to be threaded through the brake, and in particular, for it to be so threaded pneumatically, it is necessary to provide an unobstructed passage for the thread, this being done by disengaging the braking cartridge from the two braking surface rings, as a result of which two passages through the braking surface rings are opened. In a thread brake of the kind described above which is disclosed in German Offenlegungsschrift No. 23 09 578, which brake is used in conjunction with a two-for-one twisting spindle having an entry tube for a thread, the lower braking surface ring is moved downwards by forcing down the thread entry tube, as a result of which the capsule shaped braking cartridge, which consists at least in part of a ferromagnetic material, is drawn sideways and held by a permanent magnet situated in the region of the outer surface of the brake housing. In this way at least part of the threading passage is cleared to enable the thread to be threaded mechanically or pneumatically through the braking chamber, that is to say, through the brake housing.

In a thread brake described in German Auslegeschrift No. 25 43 018, which is likewise associated with a two-for-one twisting spindle and which has a capsule shaped braking cartridge, the cartridge is compressed downwards by forcing down the thread entry tube and the upper braking surface fastened to the said entry tube of the two-for-one twisting spindle, and the cartridge is then moved sideways by a tubular bridging piece in such a way that the said tubular bridging piece moves to a central threading position.

In the known thread brakes in which the braking cartridge moves away from the central position and is then held in a laterally displaced position, it may happen that the cartridge, when it returns to its central braking position, tilts or goes askew, which may adversely affect the movement of the thread which has now been threaded through. The main reason why there is this danger of the cartridge tilting or skewing, even if only momentarily, is that when the cartridge is released by holding magnets, which may for example be laterally situated, the release of the cartridge is not entirely uniform. Apart from this, the fact that displacing members to move the cartridge temporarily away from the central position also have to be provided is a disadvantage both from the point of view of the additional design costs and also from the operators point of view when operating the apparatus, because, in the course of pneumatic threading for example, additional operations have to be performed to force down the thread entry tube.

GB Patent Specification No. 1 505 744 discloses a thread brake for a two-for-one twisting spindle in which the passage for the thread to pass through the brake housing is widened out locally into a pocket, of which the inclined upper end face is in the form of a flat fixed braking surface which is inclined to one side and extends in a circle around the opening of the thread passage through which the thread enters the pocket; and in which the braking member is in the form of a braking plate of ferromagnetic material which covers the opening through which the thread enters. The thread, as it passes through the brake, is capable of pivoting this plate back from the fixed braking surface, in the direction in which the thread moves, about a pivot point situated in the region of the top of the outer edge of the plate, in opposition to the force exerted by a multi-pole permanent magnet which can be adjusted relative to the fixed braking surface. To enable a thread to be threaded pneumatically through a thread brake of this kind, it is known to pivot the braking plate by moving the tube through which the thread passes or else to lift it away from the braking surface by means of thrust pins lying parallel and adjacent to the said tube. To enable externally operable mechanical displacing members of this kind to be dispensed with, it is also known from GB Patent Specification No. 1 505 744 to provide a by-pass passage in the fixed braking surface so as to connect with the passage for the thread, through which by-pass passage the thread is passed during the pneumatic threading process without the braking plate being lifted clear of the braking surface. When tension is applied to the thread which has been through the brake, the thread becomes tight and is drawn out of the by-pass passage into the actual, i.e. effective, braking area.

In comparison with so-called plate-type thread brakes of this kind, so-called capsule-type thread brakes with a capsule-shaped braking cartridge have the advantage that there are at least two braking points, namely one in the region of the upper braking surface ring and another in the region of the lower braking surface ring, the thread moving continuously to and fro along the braking surface rings, and as it does so at the same time rubbing over the rounded or hemispherical ends of the braking cartridge. This means that the braking surfaces are kept clean at all times, thus ensuring that the thread brake remains fully operational for long periods.

OBJECTS AND SUMMARY OF THE EMBODIMENT OF THE INVENTION

The object of the invention is to design a so-called "capsule thread brake" having a braking cartridge arranged between two braking surface rings in such a way that, to thread a thread through, it is no longer necessary to move the cartridge sideways away from its proper braking position between the two braking surface rings, so that in this way it is possible to simplify on the one hand the design of the thread brake and on the other the operations performed during the threading process. What is also intended is, in particular, to make it possible for an endless thread to be threaded.

To enable this object to be achieved, the thread brake according to the invention is characterized in that the two braking surface rings are each provided with an axial threading slot, (i.e. a slot which interrupts the ring throughout the axial length of the ring).

In a thread brake of this design, a thread inserted in the insertion slots in the two braking surface rings can be automatically introduced between the braking surfaces in a simple and reliable fashion by tensioning the thread. At the inner ends of the threading slots for the thread, the thread encounters the rounded or hemispherical ends of the braking cartridge and goes on to force itself between the said ends and the braking surfaces of said rings.

The tensioning of the thread and thus its drawing into the braking area proper may be carried out by hand or automatically when the thread begins to be pulled through by the machine which will be operating on it, this happening when a winding unit or a spindle or the like starts up and applies tension to the thread.

The two threading slots are preferably arranged in a common axial plane, in which case they may widen from the center outwards in the radial direction to make it easier to place the thread in them.

The thread brake has a substantially tubular brake housing in which the ends of a capsule-shaped braking cartridge rest against the braking surface rings between a thread entry passage and a thread exit passage, the two braking surface rings being spaced axially from the mouths of the thread entry passage and the thread exit passage which are adjacent to them, is characterized in that the common axis of the braking surface rings is displaced radially from the common axis of the thread entry passage and the thread exit passage, and in that a thread guidance passage by-passes (runs past outside) the braking area formed by the two braking surface rings and the braking cartridge.

In cases where the threads are threaded pneumatically, by virtue of the fact that the two braking surface rings are spaced away from the mouths of the thread entry passage and thread exit passage adjacent them, it is possible for the flow of air carrying the thread to flow through the thread guidance passage extending laterally of the braking region, which properly consists of the braking surface rings and the braking cartridge, in such a way that the actual threading operation can take place without the need to move any part of the thread brake. When the threading process has been completed, the threaded thread is still situated outside the actual braking region, being situated substantially in the region of the two threading slots in the braking surface rings. These threading slots also form the ends of the thread guidance passage which by-passes the brake. Once the thread has been threaded, the actual insertion of the thread into the braking region, formed by the hemispherical ends of the braking cartridge and the braking surface rings, is effected in a very simple way by tensioning the thread. As a result the thread moves out of the thread guidance passage and is forcibly drawn from there through the insertion slots in the braking surface rings. At the inner end of the thread insertion slots, the thread meets the rounded or hemispherical ends of the braking cartridge and forces itself on between the said rounded or hemispherical ends and the braking surface rings. The tensioning of the thread and hence its being drawn into the braking area proper may take place by hand or automatically when the machine operating on the thread begins to pull it through, as a result of the increase of tension on the thread, which occurs for example when a spindle or a winding unit starts up.

Regarding the lateral or radial displacement between the common axis of the two braking surface rings and the thread entry passage it is immaterial whether it is the thread entry passage or the common axis of the two braking surface rings which is concentric with or central relative to the actual path followed by the thread.

In accordance with the invention provision may also be made for the threading slots in the braking surface rings to be, relative to the axes of the braking surface rings, substantially diametrically opposite to a line representing the axis of the thread entry passage, and preferably also the line marking the axis of the thread exit passage which may be situated coaxially with the thread entry passage.

In the preferred embodiment of the thread brake according to the invention is characterized in that the lower inserted body carrying one braking surface ring is formed integrally with the brake housing, the latter having on its upper side a central (concentric) bore which joins up with an axially orientated opening which is laterally or radially offset and into which the inserted body carrying the other braking surface ring projects, the latter body forming a projection from a cylinder which is a displaceable in the axial direction in the central (concentric) bore and through which the thread entry passage passes.

The thread brake according to the invention can be used wherever it is necessary to maintain a given thread tension in connection with textile machinery of any kind, such for example as in a two-for-one twisting spindle or two-for-one spinning spindle.

BRIEF DESCRIPTION OF THE DRAWING

An embodiment of the thread brake according to the invention is described in detail in what follows with reference to the drawings.

DETAILED DESCRIPTION OF PREFERRED EMBODIMENT

Figure 2:
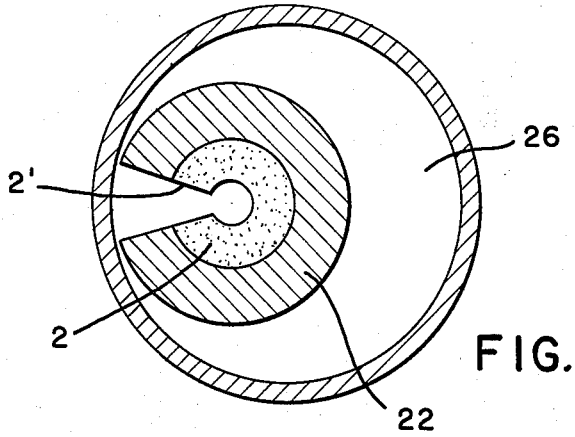
FIG. 2 is a radial sectional view on line 2—2 of FIG. 1.
Figure 1:
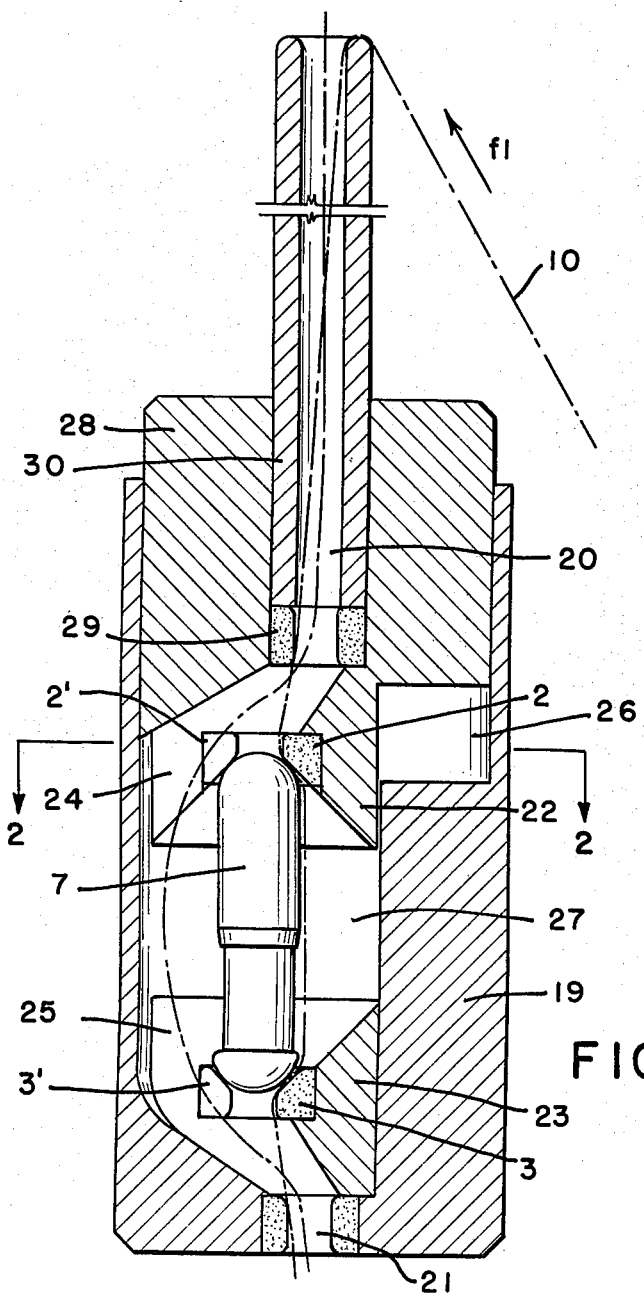
FIG. 1 is an axial section through a thread brake according to the invention.

The thread brake, which is shown in an enlarged plan view in FIGS. 1 and 2, has a housing 19 which at the top has a central or concentric bore 26 which joins up with an axially orientated opening 27 which is offset sideways or in other words radially. The bore 26 serves to receive a cylinder 28 which contains a central or concentric bore forming a thread entry passage 20. Forming a continuation of the cylinder 28 is a downwardly directed projection which extends into the laterally offset opening 27 and which constitutes an inserted body 22 in which is inserted a braking surface ring 2, which ring 2 may consist of an abrasion resistant material.

At the lower end of the brake housing 19 is situated a thread exit passage 21 above which, at a distance axially, another braking surface ring 3 is mounted in an inserted body 23 forming part of the brake housing 19.

The two braking surface rings 2 and 3 are spaced axially from the mouths of the thread entry passage 20 on the one hand and the thread exit passage 21 on the other which are respectively adjacent to them, the common axis of the two braking surface rings 2, 3 being offset radially or sideways from the common axis of the thread entry passage 20 and thread exit passage 21.

The two braking surface rings 2 and 3 are provided with lateral axial threading slots 2' and 3', respectively, which lie in a common axial plane and which have flush transitions, extending over an area, into radially extending axial slots 24, 25 in the inserted bodies 22 and 23. These axial slots 24 and 25 continue as far as the inner ends of the thread entry passage 20 and filament exit passage 21. Relative to the axes of the braking surface rings, the threading slots 2', 3' and thus the axial slots 24, 25 are substantially diametrically opposite the line marking the axis of the thread entry passage 20.

When a thread 10 is threaded through the thread brake by means of a flow of compressed or sucked-in air, a thread fed through the thread entry passage 20 passes through the axial slots in the two inserted bodies 22 and 23 to one side of the braking region that is formed by the braking surface rings 2 and 3 and the braking cartridge 7 and into the thread exit passage 21. If the thread is then tensioned or tightened, either by hand or automatically, after leaving the threading slots 2' and 3', it forces itself in the manner described above between the two hemispherical ends of the braking cartridge, positioned between the two braking rings, and the braking surface rings against which the said hemispherical ends of the braking cartridge bear.

In the embodiment of the thread brake shown in the drawing, the thread 10, indicated by the chain broken line, which moves in the direction of the arrow f1, is fed to the thread brake through a thread entry tube 30 inserted in the cylinder 28, which tube 30 registers at the bottom with an abrasion resistant ring 29.

We claim:

1. A thread brake interposed between axially aligned thread entry and thread exit passages comprising; a substantially tubular housing, said tubular housing having a capsule-shaped braking cartridge, spaced-apart axially aligned braking surface rings supported in said tubular housing between said thread entry passage and said thread exit passage for retaining said braking cartridge therein, each of said braking surface rings having a threading slot therein through said braking surface ring, said two braking surface rings having a common axis offset radially from said thread entry passage and said thread exit passage whereby a thread guidance passage is formed bypassing the braking region formed by said two braking surface rings and said braking cartridge.

2. A thread brake as claimed in claim 1, said threading slots in said braking surface rings diverge radially outwardly.

3. A thread brake as claimed in claim 1, said threading slots in said braking surface rings are, relative to the axis of said braking surface rings, diametrically opposite a line marking a common axis of said thread entry passage and said thread exit passage.

4. A thread brake as claimed in claim 3, spaced-apart inserted bodies forming continuations of said thread entry passage and thread exit passage supporting said braking surface rings, said inserted bodies having lateral insertion slots arranged to provide smooth transitions between said insertion slots and said threading slots and being firmly connected to said housing, said housing having a top central bore, and a radially offset, axially directed bore, said top central bore communicates with said radially offset, axially directed bore, one of said bodies being displaceable in an axial direction, whereby a thread will pass through said one inserted body from said thread entry passage.

5. A thread bracket as claimed in claim 3, and spaced-apart inserted bodies having a lower inserted body and an upper inserted body in said housing, said lower inserted body fixedly carrying one of said braking surface rings, said housing having a top central bore, said spaced-apart inserted bodies having an axially-extending opening therebetween which is offset radially relative to the axis of said bore and communicates with said central bore, said upper inserted body having a cylindrical configuration and a projection extending therefrom into said opening, said projection being displaceable in said opening along the axis of the latter whereby said thread entry passage extends through said upper inserted body.

* * * * *

UNITED STATES PATENT AND TRADEMARK OFFICE

CERTIFICATE OF CORRECTION

PATENT NO. : 4,405,094

DATED : September 20, 1983

INVENTOR(S) : Heinz Scheufeld

It is certified that error appears in the above-identified patent and that said Letters Patent is hereby corrected as shown below:

On the title page, at item [75] delete "Ulrich Lossa, Krefeld, both of".

Signed and Sealed this

*Twenty-first* Day of *February 1984*

[SEAL]

*Attest:*

GERALD J. MOSSINGHOFF

*Attesting Officer*

*Commissioner of Patents and Trademarks*